US005833720A

United States Patent [19]

Kent et al.

[11] Patent Number: 5,833,720

[45] Date of Patent: Nov. 10, 1998

[54] ENERGY EFFICIENT DYEING METHOD

[76] Inventors: Johnny Joe Kent, 302 Shoreline Loop, Mooresville, N.C. 28115; Eric C.S. Lee, 6322 Hawkwood La., Charlotte, N.C. 28277; Sui-Fung Yu, 2306 Ginger La. Apt. L, Charlotte, N.C. 28213

[21] Appl. No.: 898,486

[22] Filed: Jul. 22, 1997

Related U.S. Application Data

[63] Continuation-in-part of Ser. No. 639,785, Apr. 29, 1996, abandoned.

[51] Int. Cl.[6] ..... D06P 3/66; D06P 1/165

[52] U.S. Cl. ..... 8/549; 8/606; 8/576; 8/918; 8/930

[58] Field of Search ..... 8/606, 549, 576, 8/918, 930

*Primary Examiner*—Margaret Einsmann
*Attorney, Agent, or Firm*—Adams Law Firm, P.A.

[57] ABSTRACT

A method of dyeing cellulosic textile fibers with a dye which normally requires an exhaust salt. The method includes the step of forming a dye site, which includes the steps of treating the fibers with a dilute alkali solution containing an epoxy ammonium compound having an epoxy-reactive group which will permanently attach to cellulose hydroxyl groups to form a permanent cationic dye site, rinsing the fibers to remove any excess epoxy ammonium compound and at least some of the dilute alkali solution, and neutralizing any remaining alkali solution with a mild acid.

The method also includes the steps of dyeing the fibers in a dyebath containing a bifunctional reactive dye without a salt and at a temperature at or below 30° C. (86° F.) to dye exhaustion.

7 Claims, 7 Drawing Sheets

ENERGY EFFICIENT DYEING METHOD

TECHNICAL FIELD AND BACKGROUND OF THE INVENTION

This application is a continuation-in-part of U.S. Ser. No. 08/639,785, filed on Apr. 29, 1996, now abandoned.

This invention relates to a energy efficient dyeing system which avoids the use of exhaust salts and minimizes the amount of heat required to exhaust and fix the dye onto the fibers. The application is directed to dyeing of cellulosic fibers with a bifunctional reactive, or co-anchor, dye. These dyes have multireactive dye sites. This invention incorporates principles disclosed in U.S. Pat. No. 5,330,541 assigned to American Emulsion ("AE"), to which reference is made. However, this application discloses a process which results in much faster fiber pretreatment times than in the '541 Patent. In addition, dyeing takes place at a relatively low temperature. Then, the dye bath is heated at a controlled rate directly to between 80°–100° C. (175°–212° F.) This results in a savings of from ½ to 2 hours and substantial energy over conventional processes. Moreover, whereas the '541 Patent refers to yellowing above 95° C. (203° F.), no such condition results according to the process of the application.

Soaping and rinsing are also dramatically reduced, thus saving substantial time, energy and water.

Recyclable waters are possible given complete exhaustion of dye bath.

SUMMARY OF THE INVENTION

Therefore, it is an object of the invention to provide faster fixation of pretreatment chemicals to cellulosic fibers before dyeing.

Therefore, it is an object of the invention to provide a method for efficiently dyeing cellulosic fibers.

It is another object of the invention to provide a method for dyeing cellulosic fibers which does not require the use of exhaustion salts.

It is another object of the invention to provide a method of dyeing cellulosic fibers which requires less time than comparable methods.

It is another object of the invention to provide a method of dyeing cellulosic fibers which requires less energy than comparable methods.

It is another object of the invention to provide a method of dyeing cellulosic fibers which requires less water than comparable methods.

These and other objects of the present invention are achieved in the preferred embodiments disclosed below by providing a method of dyeing cellulosic textile fibers with a dye which normally requires an exhaust salt. The method includes the step of forming a dye site, which includes the steps of treating the fibers with a dilute alkali solution containing an epoxy ammonium compound having an epoxy-reactive group which will permanently attach to cellulose hydroxyl groups to form a permanent cationic dye site, rinsing the fibers to remove any excess epoxy ammonium compound and at least some of the dilute alkali solution, and neutralizing any remaining alkali solution with a mild acid.

The method also includes the steps of dyeing the fibers in a dyebath containing a bifunctional reactive dye without the aid of exhaust salt and at a temperature at or below 30° C. (86° F.) to dye exhaustion. According to one preferred embodiment of the invention, the step of treating the fibers with a dilute alkali solution includes the step of including a wetting agent in the alkali solution.

According to another preferred embodiment of the invention, the step of dyeing the fibers is carried out in the absence of a leveling agent.

According to another preferred embodiment of the invention, the method of dyeing cellulosic textile fibers with a dye which normally requires an exhaust salt includes the step of forming a dye site, which includes the steps of treating the fibers with a dilute alkali solution, containing an epoxy ammonium compound having an epoxy-reactive group which will permanently attach to cellulose hydroxyl groups to form a permanent cationic dye site, rinsing the fibers to remove any excess epoxy ammonium compound and derivatives and at least some of the dilute alkali solution, and neutralizing any remaining alkali solution with a mild acid.

The method also includes the steps of dyeing the fibers in a dyebath containing a bifunctional reactive dye without a salt and at a temperature at or below 30° C. (86° F.) to dye exhaustion and heating the exhausted dyebath containing the fibers to at least 80° C. (175° F.) with mild alkali to enhance the dye fastness of the dye on the fibers. The resultant fabric required no soaping to achieve universal acceptable wash fastness properties.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
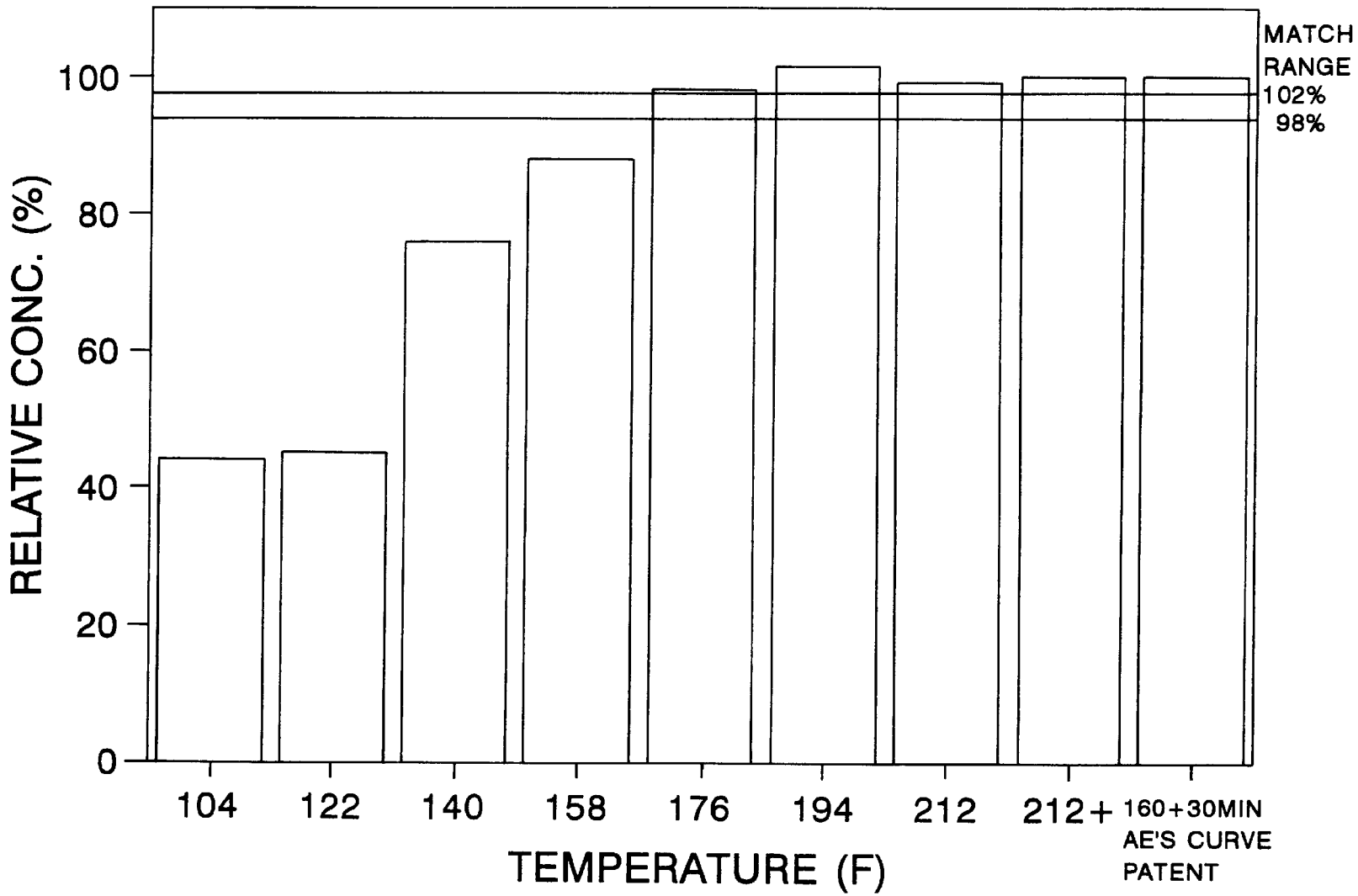
FIG. 1 is a dye site formation table which correlates dye site formation with pretreatment temperature.

The method according to the invention is a two-part process, which includes several sub-steps. The first part involves applying a quaternary ammonium compound, such as an epoxy ammonium compound, to the cellulosic material. This forms permanent cationic dye sites on the cellulosic material.

More specifically, the dye site is formed by first pretreating the fibers, which may be in fiber, yarn or fabric form, with a dilute alkali solution containing an epoxy ammonium compound having an epoxy-reactive group which will permanently react to cellulose hydroxyl groups to form a permanent cationic dye site. The fibers are rinsed to remove any excess epoxy ammonium compound and at least some of the dilute alkali solution. Any remaining alkali solution is neutralized with a mild acid.

At this point, the cationic dye sites have been formed on the fibers, and the fibers are ready to receive the dye.

Next, the fibers are dyed in a dyebath containing a bifunctional reactive dye. No salt is used. The dyeing is carried to exhaustion at a temperature of 30° C. (86° F.). After exhaustion of the dyestuff, a small amount of soda ash is added and the dyebath is heated to a temperature of at least 80° C. (175° F.) to enhance the dye fastness of the dye on the fibers.

Proof of the efficacy of the process was obtained by treating identical fabric according to the process set out in U.S. Pat. No. 5,330,541 and the process according to the present invention, using the same amount of chemicals and dyeing the fabric with the same concentration of dye. The dyed samples were then compared with each other for depth of shade visually and by a BYK Gardner Spectrophotometer. The results show that dyeing quality at least equal to the '541 process is obtained with the method of the present invention.

PREPARATION OF CONTROL SAMPLES—'541 PROCESS

A stock solution of the following pretreatment liquid was made:

5.0% Amdye PTC (quaternary (epoxy) ammonium compound)
2.5% caustic soda
0.5% wetting agent
92.0% water (All percentages by volume)

In accordance with the '541 Patent, 100 ml. of this solution was poured into a 250 ml. AHIBA laboratory dye beaker and heated to a starting temperature of 30° C. (86° F.). A 10 g. cotton fabric sample was added to the solution and held at the 30° C. (86° F.) in an AHIBA laboratory dye machine for a period of 15 minutes. The temperature was raised to 70° C. (160° F.) and maintained for an additional 30 minutes. The sample was rinsed and neutralized, and rinsed again. This sample served as a control standard against which samples according to the method of the invention were compared. See FIG. 2.

Rapid Dye Site Formation Experiment

Eight additional beakers and samples were prepared in the same manner as the Control Sample above. Heating was again started at 30° C. (86° F.) and continued at a rate of 1.5° C. (3.4° F.) per minute to 100° C. (212° F.). Temperature was maintained at this level until the total processing time was equal to the standard processing time.

Figure 2:
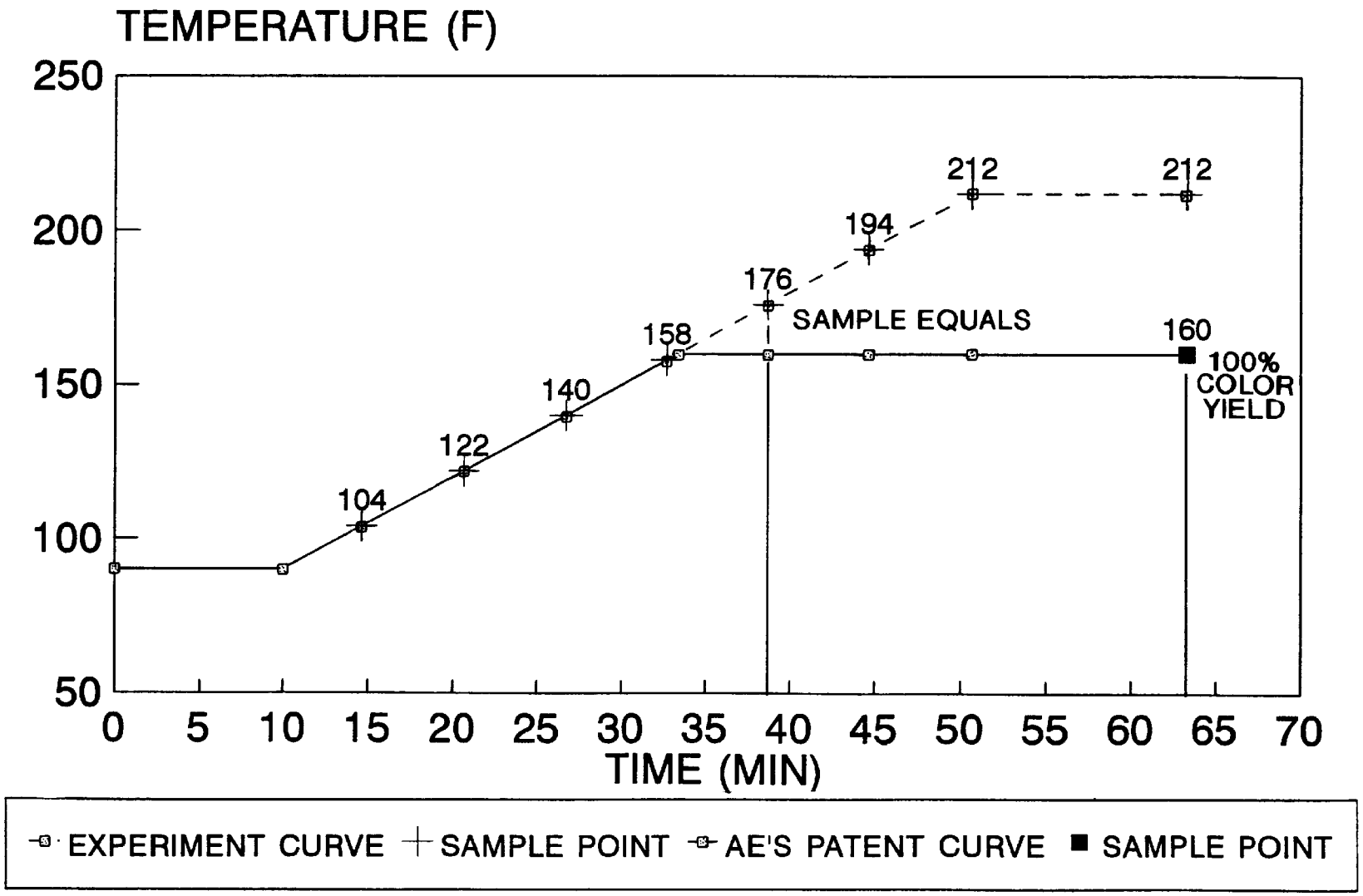
FIG. 2 is a dye site formation table which demonstrates a dye site formation method according to Prior Art U.S. Pat. No. 5,330,541.

Starting at approximately 40° C. (104° F.) a sample was taken out of the laboratory dye machine at 10° C. (18° F.) degree intervals. This continued until 100° C. (212° F.) was reached. A final sample was taken out after holding the sample in the 100° C. (212° F.) temperature bath for an additional 15 minutes. FIG. 2.

As a sample was removed from the dye machine, it was immediately cooled and washed in cold water to prevent further reaction. After all samples were individually washed, they were grouped together and washed and neutralized with a weak acid. Final rinsing was in distilled water.

Dyeing

A trichromatic stock dye solution was made containing the following:

| | |
|---|---|
| 0.35% | Splendid Red CD-5B (Red 195) |
| 2.57% | Splendid Navy CD-R (Blue 194) |
| 0.37% | Splendid Orange CD-R (Orange 122) |

Dye solutions for each sample was made by measuring out 10 ml. of the stock solution and diluting to 100 ml. with distilled water. A wetting agent (0.5% Amwet AFX) was added to insure total penetration of the dye solution to the treated samples. The concentration of the dye present was high enough so that an excess remained in individual solutions after dyeing was completed.

The solutions were added to 250 ml. flasks. The treated fabric samples were added to the flasks. The flasks were placed in a Jubalo SW-20C laboratory dyeing machine set at 30° C. (86° F.). The temperature was maintained for 5 minutes. The temperature was raised to 95° C. (203° F.) and held for 30 minutes, then cooled back to 40° C. (104° F.).

The samples were rinsed with hot water and then soaped at 60° C. (140° F.) for 10 minutes. Cooling back and final rinsing steps were carried out with cold water, and then the samples were dried.

Using the control sample treated and held for 30 minutes at 60° C. (140° F.) as the standard, the reflectance of each sample was measured, recorded and compared by a BYK GARDNER spectro photo metric color measurement system. The results, as shown in FIG. 1, indicate that when a temperature of 80° C. (175° F.) is attained during dyesite formation, all samples after that temperature dye the same. It was therefore concluded that once the fabric and pretreatment solutions reached 80° C. (175° F.) the reaction was complete without the necessity of a holding period.

FIG. 1 plots temperature vs. the percent of depth of the standard shade. The human eye is generally thought to be able to detect differences of 4% or more. Thus, a shade which is within 96% of standard is considered a match. As noted on FIG. 1, at 80° C. (175° F.), 98% of shade was obtained. As is clear from the foregoing, good dye results can be obtained using this process, but at the cost of relatively high temperatures and long holding times.

Figure 5A:
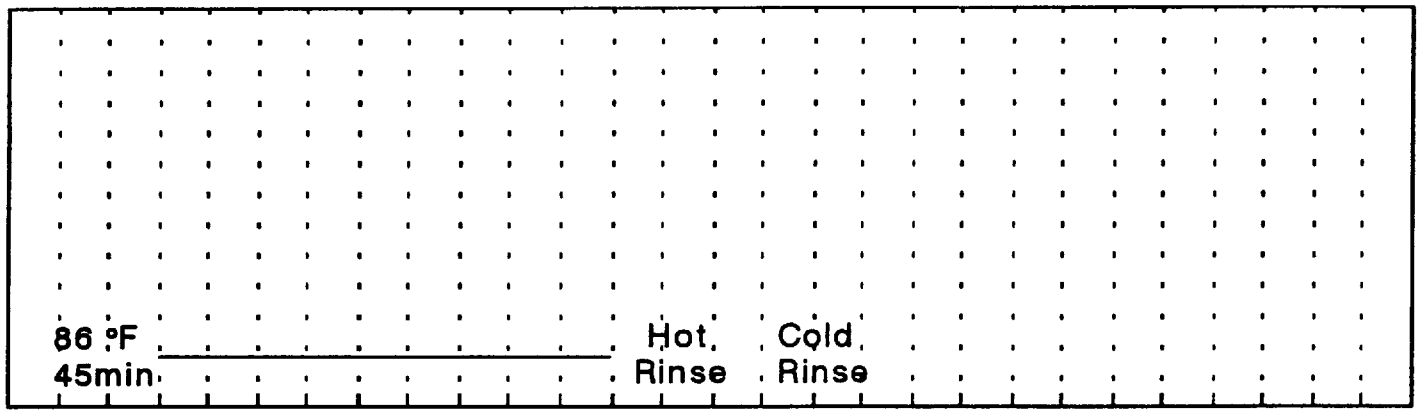
FIGS. 5A–D are tables showing curves used in exhaust dye tests.

Development of the method of the invention proceeded by doing dye screening tests. For a reference point 30° C. (86° F.) was used during the testing. Dye exhaustion can be obtained at lower temperatures, however, 30° C. (86° F.) is an average year-around starting temperature for most textile dyeing procedures. FIG. 5A.

There are numerous classes of cellulosic dyes-direct, reactive, and sulfurs, for example. The '541 Patent indicates successful dyeing with all of these classes. This, of course, provides an enormous number of choices and combinations that permit dyeing of cellulosic fibers without the use of an exhaust salt.

Research was carried out to find the best trichromatic dye combination for this process. Any shade of color is made up of varying amounts of three primary colors—red, yellow and blue. The use of complimentary colors permits "graying" of the shades in accordance with accepted color theory. In practice, however, the varying hues, brightnesses and other characteristics individual to any particular color means that no three dyes can be mixed in such a way as to match all shades. However, if a compatible red, yellow, and blue combination can be found, these primary colors along with compatible shading dyes can match a majority of shades with excellent evenness and fastness properties.

During this screening test is was discovered that some dyes exhaust more completely and quickly using the method of the invention than in conventional dyeing, including the method of the '541 Patent. This phenomenon is undesirable in conventional dyeing, since if the dye strikes too quickly, and may result in unevenly dyed yarn or fabric.

It was discovered by accident that some of these dyes totally and completely exhaust at much lower temperatures than was previously thought, as indicated by conventional dyeing practice and the disclosure of the '541 Patent. Moreover, the fabrics dyed with these dyes according to the method of the invention exhibit exceptionally good fastness, evenness and uniformity.

A number of dyes were tested for their compatibility with this system. Fastness properties were the first selection criteria. The strike rate was then tested so that dyeing uniformity during the colorization process could be achieved.

Screening Test

Ten gram samples were first prepared according to the dye site formation method set out above.

A 1% solution of the dye to be screened was made. Ten ml. of the test solution was pipetted into a 250 ml. flask and diluted to a final volume of 100 ml. The test cotton fabrics were wetted out in a solution of 0.50% Amwet AFX uniformly squeezed through a laboratory padder and added to the dye solution. The flask was placed in a Jubalo SW-20C laboratory dye machine and the dye solution was raised to a temperature of 30° C. (86° F.). The dye solution was observed and held for a maximum of 45 minutes. If a test dye solution exhausted to clear solution within the 45 minute test period, the time to exhaustion was noted to provide an indication of relative strike rates.

Figure 3:
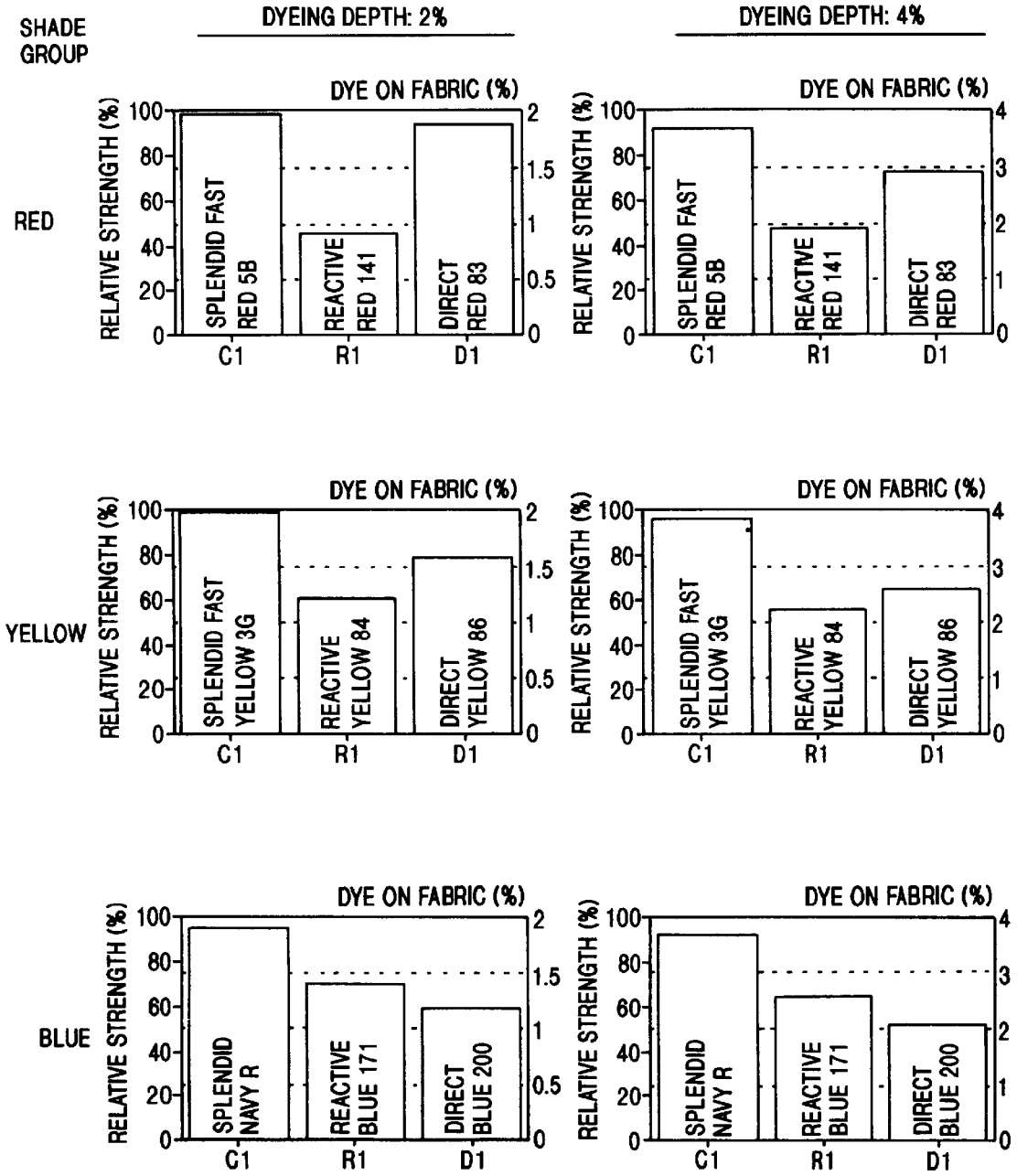
FIG. 3 are tables which demonstrate the ability to totally exhaust bifunctional dyes at 30° C. (86° F.)

It was discovered by accident that a selection of bifunctional reactive dyes totally exhausted onto the fabric at room temperatures of approximately 30° C. (86° F.). By carefully matching the amount of pretreatment to the amount of dye necessary to make a shade this can be achieved for most all depths of shade see FIG. 3. These dyes have multireactive sites which differ from other types of reactive dyes. These dyes thus form the basis of the method according to the invention of this application.

Figure 4:
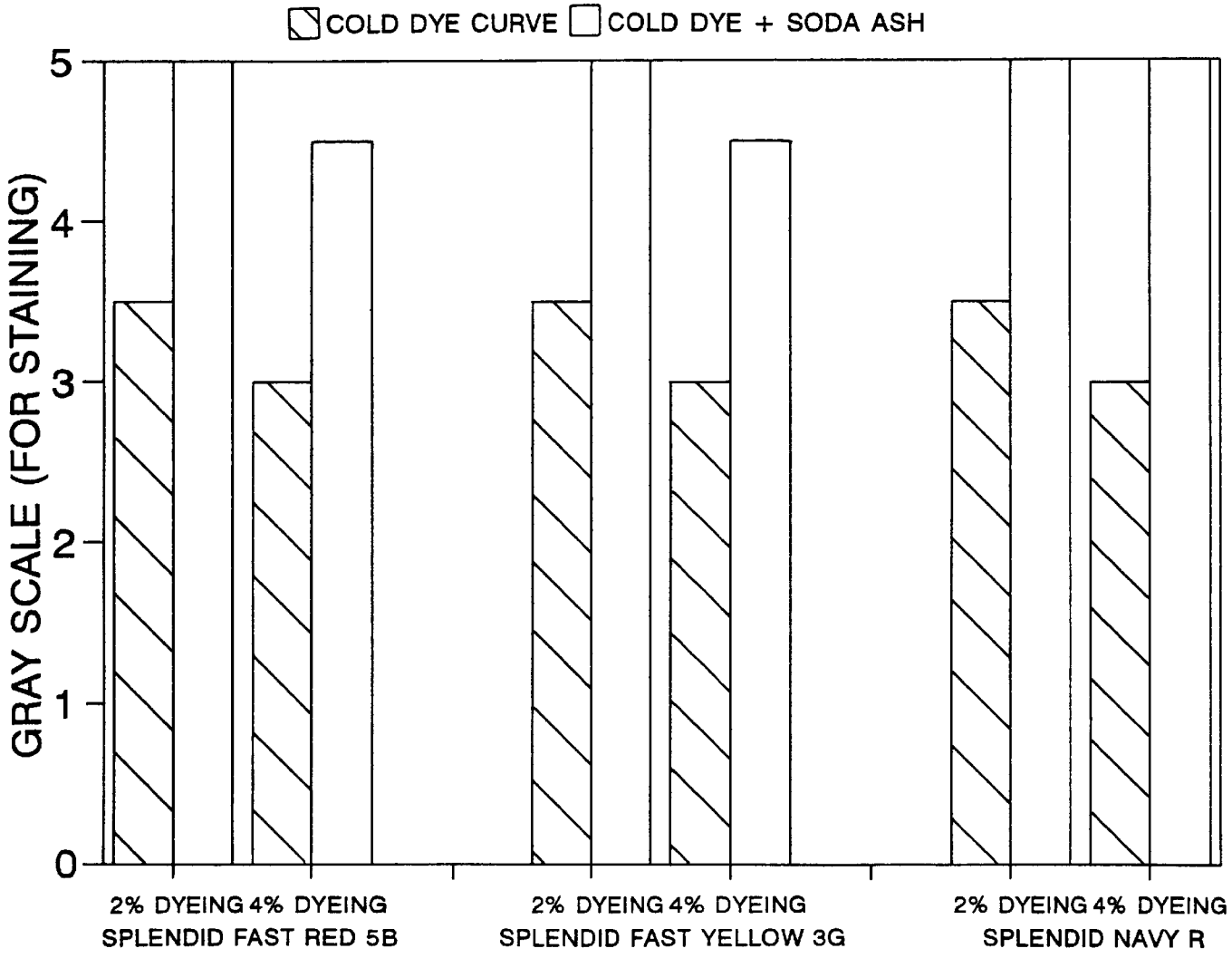
FIG. 4 is a table demonstrating dye fastness of a group of trichromatic dyes dyed cold with and without addition of soda ash to the dye bath.
Figure 5B:
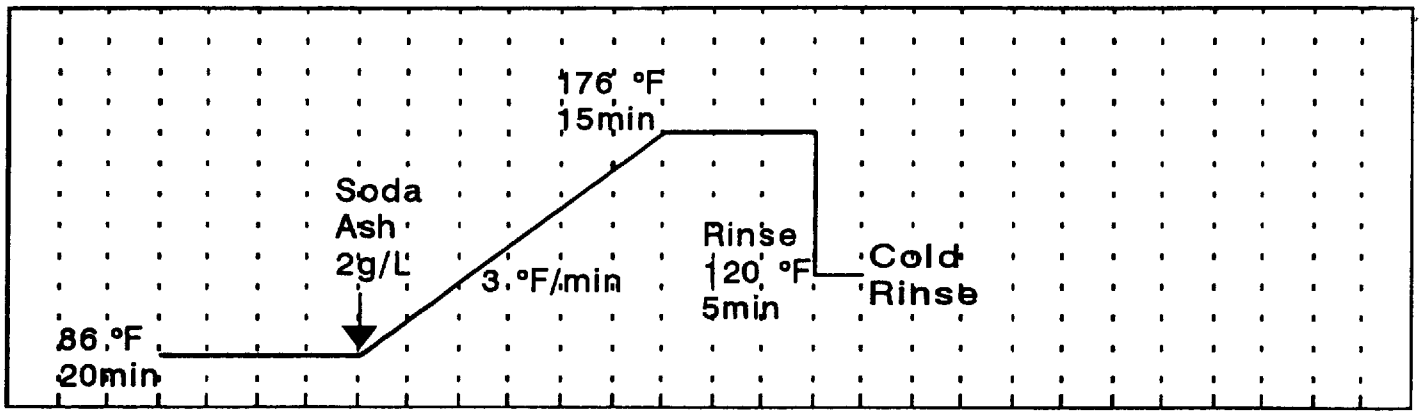

Fastness testing of the fully exhausted bi-functional dyes showed acceptable results for many applications using the processing curve of FIG. 5A. Results for other applications were not acceptable without some increase in temperature and the addition of mild alkali, as indicated in FIG. 5B. The fastness results are shown in FIG. 4.

To fully test the efficacy of the method according to the invention in comparison to the method of '541 Patent, a trichromatic selection of the different dye classes listed in the '541 Patent was selected for testing. These were:

| Group 1-Bifunctional Dyes |
|---|
| Splendid Red CD-5B (Red 195) |
| Splendid Navy CD-R (Blue 194) |
| Splendid Yellow CD-3G (Yellow 145) |

| Group 2-Reactive Comparison Dyes |
|---|
| Red HE7B (Reactive Red 141) |
| Navy HER (Reactive Blue 171) |
| Yellow HE4R (Reactive Yellow 84) |

These reactive dyes are from Zeneca's Procion line of reactive dyes, which have proven to be the most reliable and effective of the various reactive types available on the market for use with the method of the '541 Patent. The CI numbers of the test dyes as listed in the '541 Patent are Reactive Red 141, Reactive Blue 171, and Reactive Yellow 84.

| Group 3-Direct Comparison Dyes |
|---|
| Direct Rubine 3LS (Direct Red 83) |
| Blue 4BL (Direct Blue 200) |
| Yellow RL (Direct Yellow 86) |

As with the reactive dyes noted above, these direct dyes have shown excellent exhaustability and greatly improved fastness properties over conventional dyeing when used in the '541 Patent method.

Sets of 10 g. cotton fabric samples were treated with solutions of 3% and 5% volumetrically measured amounts of Amdye PTC according to the dye site formation method set out above.

Then, these cotton fabric samples were dyed with 2% and 4% test dye solutions, respectively.

All dyeing procedures were started at 30° C. (86° F.). Sets of cotton test fabrics in solutions with Group 1, Group 2 or Group 3 dyes, were held at 30° C. (86° F.) for 45 minutes to test the cold exhaust capability. See FIG. 5B.

Figure 5C:
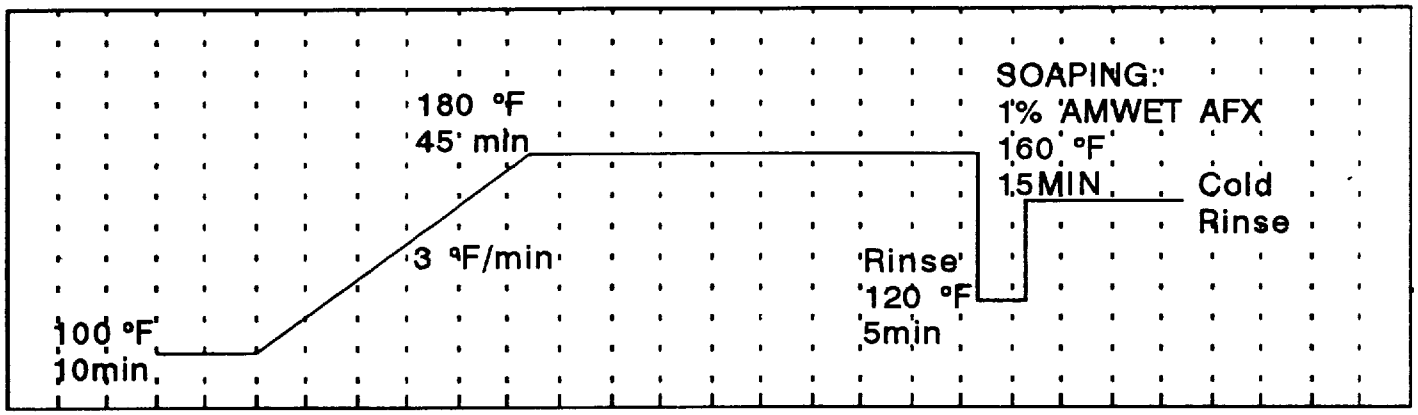
Figure 5D:
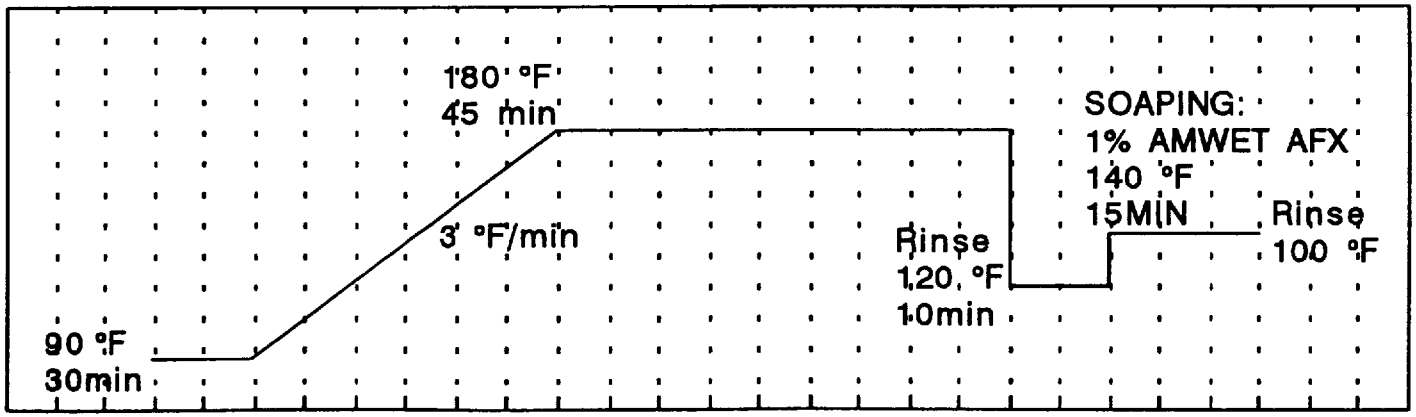
Figure 6:
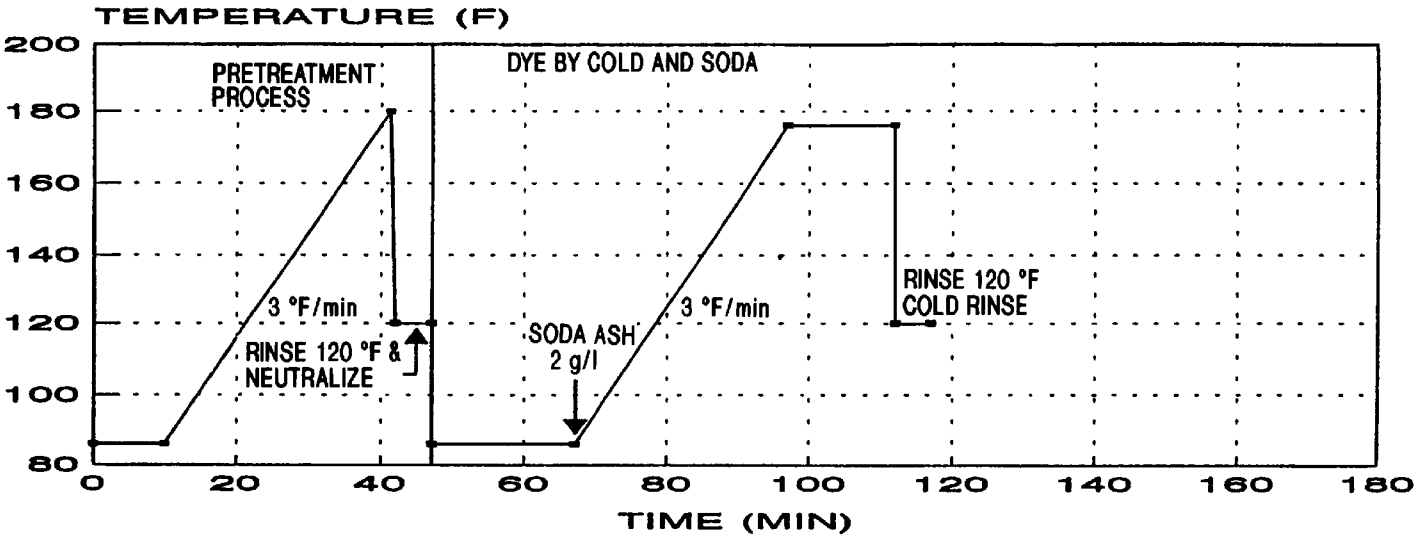
FIG. 6 are tables showing a composite comparison of the complete procedure according to an embodiment of the invention vs. the procedure of the prior art '541 Patent.
Figure 6:
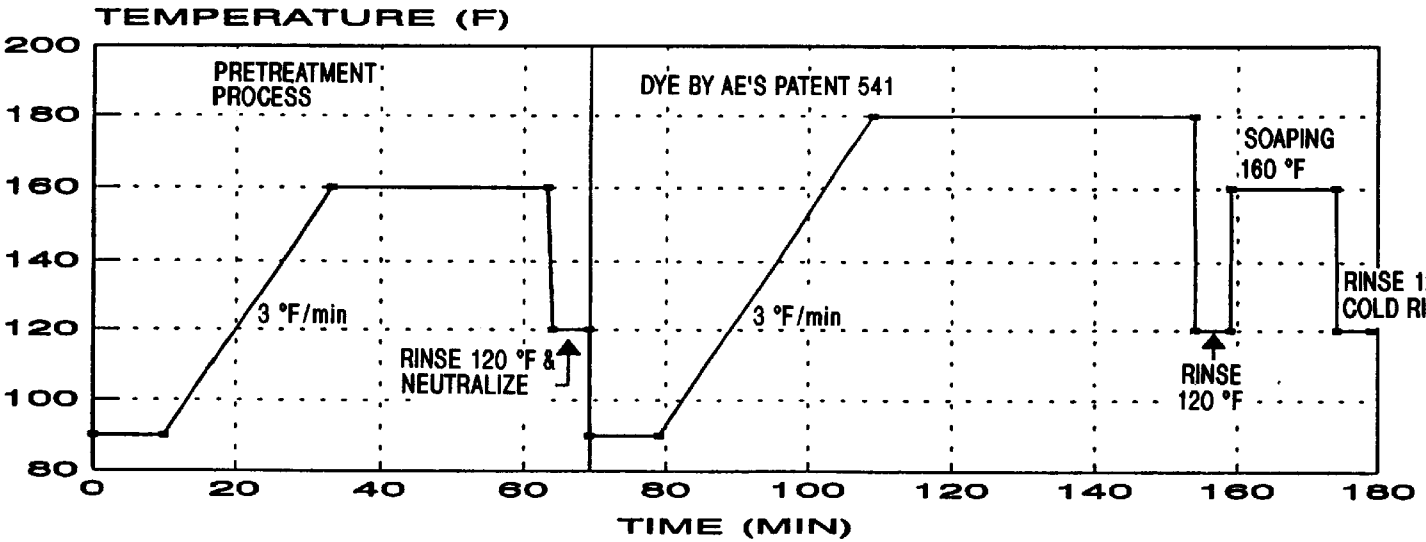

A different sample treated and exposed to the same concentrations of Amdye PTC and the Group 2 or Group 3 dyes were then processed according to the method set out in the '541 Patent. This method generally heats the dyeing solutions to 30° C. (86° F.) and after a short holding period, raises the temperature to 90° C. (194° F.) and holds that temperature for 15 minutes. See FIGS. 5C and 5D.

A further set of cotton test fabrics using Group 1 bifunctional dyes was dyed according to the dye curve shown in FIG. 4.

The dyes identified in Group I are commercially available dyes sold under the trademark "Splendid" and are characterized by having two reactive groups of different reactivity levels and chemical makeup.

These reactive dyes have a monochlorotriazine (medium reactivity) and a vinyl sulfone (high reactivity) group in the dye molecule. Reactive dyes having the same groups are sold by Sumitomo Chemical Co., Ltd. under the trademark "Sumifix Supra."

The resultant dyed fabrics were measured for depth of shade by the BYK GARDNER spectro photo metric measuring system. By comparing the results of the initial dyed samples against the samples subjected to heating, the relative ability of the dye to achieve an energy efficient process was determined. Further fastness testing indicated that the process would have universally acceptable properties.

Summary of Test Results

1. The Group 1 dyes (bifunctional dyes) exhibited the highest relative color yield when dyed at 30° C. (86° F.), FIG. 3, and excellent wash fastness when dyed by the curve in FIG. 5B.

2. The Group 2 dyes (reactive dyes) have good wash fastness when dyed at 30° C. (86° F.) but poorer color yield.

3. The Group 3 dyes (direct dyes) have good dye exhaustion, but their rate of dyeing and fastness properties may lead to uneven dyeing and poorer wash fastness than the Group 1 dyes.

The excellent yield and color fastness of the Group 1 dyes also significantly reduced rinsing and soaping times.

The foregoing test results demonstrate that by using bifunctional dyes, excellent quality dyed cellulosic fabrics can be obtained at relatively low temperatures without significant holding times. Complete dye exhaustion and the absence of salt substantially improves the quality of waste water and has the potential to substantially reduce post-dying water treatment processes now required in many localities, and improve otherwise discharge water quality.

A method of dyeing cellulosic material is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

We claim:

1. A method of dyeing cellulosic textile fibers with a bifunctional dye, comprising the steps of:

(a) forming a dye site, which includes the steps of:

(i) treating the fibers with a dilute alkali solution containing an epoxy ammonium compound having an epoxy-reactive group which will permanently attach to cellulose hydroxyl groups to form a permanent cationic dye site;

(ii) rinsing the fibers to remove any excess epoxy ammonium compound and at least some of the dilute alkali solution; and (iii) neutralizing any remaining alkali solution with a mild acid; and (b) dyeing the fibers in a dyebath containing a bifunctional reactive dye without a salt and at or below 30° C. (86° F.) to dye exhaustion, said bifunctional reactive dye having both monochlorotriazine and monovinylsulfone reactive radicals.

2. A method according to claim 1, wherein the step of treating the fibers with a dilute alkali epoxy ammonium compound solution includes the step of including a wetting agent in the alkali solution.

3. A method according to claim 1, wherein step (b) is carried out in the absence of a leveling agent.

4. A method of dyeing cellulosic textile fibers with a bifunctional dye, comprising the steps of:

(a) forming a dye site, which includes the steps of:

(i) treating the fibers with a dilute alkali solution containing an epoxy ammonium compound having an epoxy-reactive group which will permanently attach to cellulose hydroxyl groups to form a permanent cationic dye site;

(ii) rinsing the fibers to remove any excess epoxy ammonium compound and at least some of the dilute alkali solution; and (iii) neutralizing any remaining alkali solution with a mild acid;

(b) dyeing the fibers in a dyebath containing a bifunctional reactive dye without a salt and at or below 30° C. (86° F.) to dye exhaustion, said bifunctional reactive dye having both monochlorotriazine and monovinylsulfone reactive radicals; and (c) heating the exhausted dyebath containing the fibers to at least 80° C. (175° F.) with mild alkali to enhance the dye fastness of the dye on the fibers.

5. A method according to claim 4, wherein the step of treating the fibers with a dilute alkali solution includes the step of including a wetting agent in the alkali epoxy ammonium compound solution.

6. A method according to claim 4, wherein step (b) is carried out in the absence of a leveling agent.

7. A method according to claim 4, wherein the step (c) includes the step of adding soda ash to the dye bath.

* * * * *